US008562386B2

(12) United States Patent
Carlson et al.

(10) Patent No.: US 8,562,386 B2
(45) Date of Patent: Oct. 22, 2013

(54) MOBILE SKATEBOARD-SHAPED TOY WITH A FLYWHEEL

(75) Inventors: Gabriel Carlson, Los Angeles, CA (US); Dominic Laurienzo, Los Angeles, CA (US); Dion Fields, Thousand Oaks, CA (US); Michael Bernstein, Hermosa Beach, CA (US)

(73) Assignee: JAKKS Pacific, Inc., Malibu, CA (US)

( * ) Notice: Subject to any disclaimer, the term of this patent is extended or adjusted under 35 U.S.C. 154(b) by 0 days.

(21) Appl. No.: 12/660,238

(22) Filed: Feb. 22, 2010

(65) Prior Publication Data

US 2010/0330876 A1 Dec. 30, 2010

Related U.S. Application Data

(63) Continuation-in-part of application No. 12/587,625, filed on Oct. 10, 2009.

(60) Provisional application No. 61/195,812, filed on Oct. 10, 2008, provisional application No. 61/208,169, filed on Feb. 21, 2009.

(51) Int. Cl.
*A63H 17/00* (2006.01)

(52) U.S. Cl.
USPC ..... 446/431; 446/462; 446/465

(58) Field of Classification Search
USPC ..... 74/572.1–572.21; 446/462, 236, 233
See application file for complete search history.

(56) References Cited

U.S. PATENT DOCUMENTS

| | | | | |
|---|---|---|---|---|
| 837,040 | A * | 11/1906 | Clark | 446/462 |
| 944,096 | A | 12/1909 | Kirkby | |
| 1,098,895 | A | 6/1914 | Edgar | |
| 1,495,911 | A | 5/1923 | Lemoine | |
| 1,584,979 | A | 5/1926 | Clausen | |
| 2,124,302 | A * | 7/1938 | Lohr et al. | 446/437 |
| 2,148,374 | A | 2/1939 | Hogan | |
| 2,195,083 | A | 3/1940 | Einfalt | |
| 2,736,132 | A | 2/1956 | Murray | |
| 3,318,600 | A | 5/1967 | Glass et al. | |
| 3,603,032 | A | 9/1971 | Heron | |
| 3,650,067 | A | 3/1972 | Greenwood | |
| 3,703,048 | A | 11/1972 | Cooper | |
| 3,726,146 | A * | 4/1973 | Mishler | 446/233 |
| 2,932,957 | A | 1/1976 | Morrison et al. | |

(Continued)

OTHER PUBLICATIONS

Office Action for U.S. Appl. No. 12/587,625, dated Jan. 10, 2012.

(Continued)

*Primary Examiner* — Gene Kim
*Assistant Examiner* — Urszula M Cegielnik
(74) *Attorney, Agent, or Firm* — Tope-McKay & Associates

(57) ABSTRACT

A mobile skateboard-shaped toy which is propelled by a displaceable flywheel is described. The skateboard-shaped toy comprises a skateboard deck with the flywheel positioned within the skateboard deck. The flywheel is positioned such that the flywheel protrudes beyond a top portion and a bottom portion of the skateboard deck. The flywheel is rotatable within the skateboard deck to change a rotational direction of the flywheel with respect to a major axis of the skateboard deck. Additionally, the flywheel can be repositioned at different ride heights within the skateboard deck. In one aspect, the flywheel is removable from the skateboard deck to allow the flywheel to be easily repositioned within the skateboard deck or replaced with another flywheel.

16 Claims, 7 Drawing Sheets

(56) References Cited

U.S. PATENT DOCUMENTS

| | | | | | |
|---|---|---|---|---|---|
| 3,932,957 | A | * | 1/1976 | Morrison et al. | 446/234 |
| 3,984,939 | A | | 10/1976 | Wolgamot et al. | |
| 4,059,918 | A | | 11/1977 | Matsushiro | |
| RE30,299 | E | | 6/1980 | Greenwood | |
| 4,300,308 | A | | 11/1981 | Ikeda | |
| 4,373,290 | A | | 2/1983 | Goldfarb et al. | |
| 4,475,305 | A | | 10/1984 | Kawakami et al. | |
| 4,536,168 | A | | 8/1985 | Stephens | |
| 4,556,397 | A | | 12/1985 | Arad et al. | |
| 4,631,041 | A | | 12/1986 | Chang et al. | |
| 4,655,725 | A | | 4/1987 | Torres | |
| 4,685,894 | A | | 8/1987 | Beny et al. | |
| 4,772,241 | A | | 9/1988 | Bro et al. | |
| 4,892,503 | A | | 1/1990 | Kumazawa | |
| 4,982,961 | A | | 1/1991 | Ichimura | |
| 5,087,219 | A | | 2/1992 | Price | |
| 5,165,710 | A | * | 11/1992 | Runyon | 280/87.042 |
| 5,823,545 | A | * | 10/1998 | Goeckel | 280/11.231 |
| 5,823,845 | A | | 10/1998 | O'Berrigan | |
| 5,957,214 | A | * | 9/1999 | Martinez | 172/15 |
| 5,957,745 | A | | 9/1999 | Johnson et al. | |
| 6,280,286 | B1 | | 8/2001 | Andrews | |
| 6,676,476 | B1 | * | 1/2004 | Lund et al. | 446/462 |
| 6,682,394 | B2 | | 1/2004 | Tilbor et al. | |
| 6,764,374 | B2 | | 7/2004 | Tilbor et al. | |
| 6,786,796 | B2 | | 9/2004 | Suto | |
| 7,329,167 | B2 | | 2/2008 | Nagasaka et al. | |
| 7,445,539 | B2 | | 11/2008 | Laurienzo et al. | |
| 7,811,217 | B2 | * | 10/2010 | Odien | 482/147 |
| 2005/0181703 | A1 | * | 8/2005 | Kuralt | 446/454 |
| 2006/0292962 | A1 | | 12/2006 | Takeyasu et al. | |
| 2007/0093363 | A1 | * | 4/2007 | Sharps | 482/94 |
| 2007/0207699 | A1 | | 9/2007 | Hoeting et al. | |
| 2008/0032597 | A1 | * | 2/2008 | Lo | 446/466 |

OTHER PUBLICATIONS

Office Action Response for U.S. Appl. No. 12/587,625, dated Apr. 2, 2012.

Office Action for U.S. Appl. No. 12/587,625, dated May 7, 2012.

Office Action Response for U.S. Appl. No. 12/587,625, dated Aug. 6, 2012.

* cited by examiner

MOBILE SKATEBOARD-SHAPED TOY WITH A FLYWHEEL

PRIORITY CLAIM

This is a Continuation-in-Part patent application of U.S. patent application Ser. No. 12/587,625 filed in the United States on Oct. 10, 2009, titled, "Mobile Toy with Displaceable Flywheel", which is a Non-Provisional patent application of expired U.S. Provisional Application No. 61/195,812 filed in the United States on Oct. 10, 2008, titled, "Mobile Toy with Removable Flywheel." This application is also a Non-Provisional patent application of U.S. Provisional Application No. 61/208,169 filed in the United States on Feb. 21, 2009, titled, "Mobile Skateboard-Shaped Toy with a Flywheel."

BACKGROUND OF THE INVENTION (1) Field of Invention

The present invention relates to a mobile toy and, more particularly, to a mobile skateboard-shaped toy which is propelled by a displaceable flywheel.

(2) Description of Related Art

Toy vehicles which are propelled by flywheels have long been known in the art. Conventionally, toy vehicles are designed to include a gear train to transmit rotation of a permanently affixed flywheel to the drive axles of other wheels. Since the flywheel is not removable or repositionable, the toy vehicle is limited to one type of movement as well as one type of surface for propelling the toy vehicle.

Thus, a continuing need exists for a mobile toy with a displaceable flywheel to allow the mobile toy to perform various stunts, to be utilized on various play surfaces, and to easily change the appearance of the mobile toy.

SUMMARY OF INVENTION

The present invention relates to mobile skateboard-shaped toy with a flywheel. The skateboard-shaped toy comprises a skateboard deck with a displaceable flywheel attachable with the skateboard deck.

In another aspect, the flywheel is a displaceable flywheel.

In another aspect, the displaceable flywheel is positioned in the skateboard deck such that the displaceable flywheel protrudes beyond a top portion and a bottom portion of the skateboard deck.

In another aspect, the displaceable flywheel has a rotational axis, and the skateboard deck is formed such that the displaceable flywheel is repositionable with respect to the skateboard deck, such that repositioning the displaceable flywheel within the skateboard deck alters the rotational axis of the displaceable flywheel with respect to the skateboard deck.

In another aspect, the displaceable flywheel is repositionable within the skateboard deck at different heights.

In yet another aspect, the displaceable flywheel is removable from the skateboard deck, such that the displaceable flywheel may be replaced with another displaceable flywheel.

In another aspect, a sub-chassis is attached with the skateboard deck, wherein the displaceable flywheel is positioned within the sub-chassis.

In another aspect, the sub-chassis is removably attached with the skateboard deck.

Finally, as can be appreciated by one in the art, the present invention also comprises a method for forming the mobile skateboard-shaped toy with a displaceable flywheel described herein. The method for forming the device includes a plurality of acts of forming, attaching, connecting, etc., each of the described components to arrive at the present invention.

BRIEF DESCRIPTION OF THE DRAWINGS

The objects, features and advantages of the present invention will be apparent from the following detailed descriptions of the various aspects of the invention in conjunction with reference to the following drawings, where.

DETAILED DESCRIPTION

The present invention relates to a mobile toy and, more particularly, to a mobile skateboard-shaped toy which is propelled by a flywheel. The following description is presented to enable one of ordinary skill in the art to make and use the invention and to incorporate it in the context of particular applications. Various modifications, as well as a variety of uses in different applications will be readily apparent to those skilled in the art, and the general principles defined herein may be applied to a wide range of embodiments. Thus, the present invention is not intended to be limited to the embodiments presented, but is to be accorded the widest scope consistent with the principles and novel features disclosed herein.

In the following detailed description, numerous specific details are set forth in order to provide a more thorough understanding of the present invention. However, it will be apparent to one skilled in the art that the present invention may be practiced without necessarily being limited to these specific details. In other instances, well-known structures and devices are shown in block diagram form, rather than in detail, in order to avoid obscuring the present invention.

The reader's attention is directed to all papers and documents which are filed concurrently with this specification and which are open to public inspection with this specification, and the contents of all such papers and documents are incorporated herein by reference. All the features disclosed in this specification, (including any accompanying claims, abstract, and drawings) may be replaced by alternative features serving the same, equivalent or similar purpose, unless expressly stated otherwise. Thus, unless expressly stated otherwise, each feature disclosed is one example only of a generic series of equivalent or similar features.

Furthermore, any element in a claim that does not explicitly state "means for" performing a specified function, or "step for" performing a specific function, is not to be interpreted as a "means" or "step" clause as specified in 35 U.S.C. Section 112, Paragraph 6. In particular, the use of "step of" or "act of" in the claims herein is not intended to invoke the provisions of 35 U.S.C. 112, Paragraph 6.

Please note, if used, the labels left, right, front, back, top, bottom, forward, reverse, clockwise and counter clockwise have been used for convenience purposes only and are not intended to imply any particular fixed direction. Instead, they are used to reflect relative locations and/or directions between various portions of an object.

(1) Description

Figure 1:
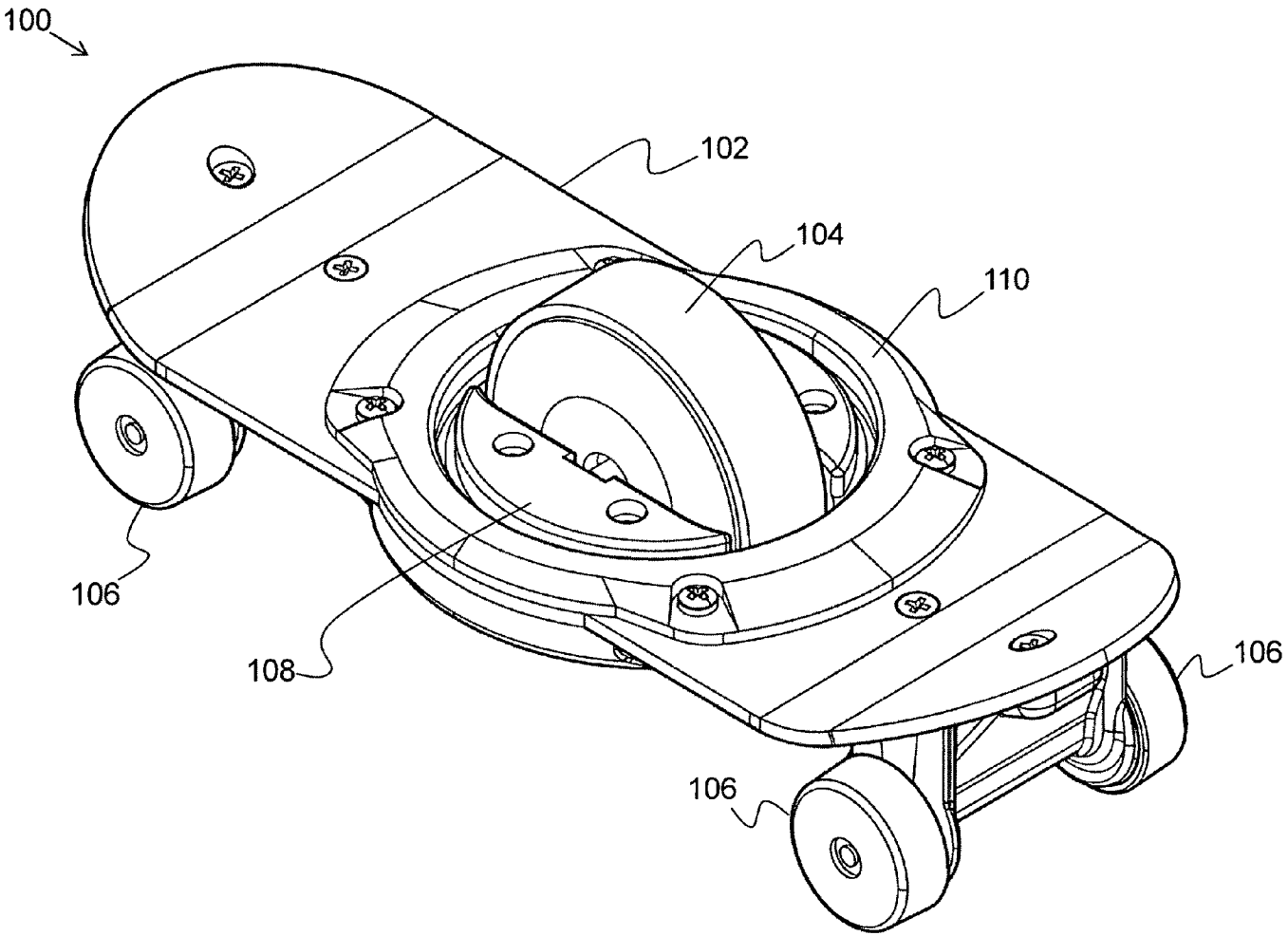
FIG. 1 illustrates a top, perspective-view of a mobile skateboard-shaped toy with a flywheel, depicting the flywheel in a parallel position according to the present invention.

The present invention relates to a mobile toy with a displaceable fly wheel. In a desired aspect, the mobile toy is a skateboard-shaped toy 100, as shown in FIG. 1. The skateboard-shaped toy 100 comprises an elongated skateboard deck 102 with a displaceable flywheel 104 attachable thereto. Further, the displaceable flywheel 104 can be removable from the skateboard deck 102 or fixed within the skateboard deck 102. Additionally, the displaceable flywheel 104 can be manually rotated and repositioned within the skateboard deck 102 to change a rotation direction with respect to a long axis of the skateboard deck 102.

The skateboard-shaped toy 100 comprises wheels 106 connected with the skateboard deck 102. As can be appreciated by one skilled in the art, the skateboard-shaped toy 100 may include any suitable number of wheels 106 connected with the skateboard deck 102, a non-limiting example of which includes four wheels 106. The wheels 106 can be configured to rotate or remain fixed, such that only the flywheel 104 rotates. The skateboard deck 102 may be comprised of any durable and lightweight material, non-limiting examples of which include plastic and metal.

As can be appreciated by one skilled in the art, the flywheel may be comprised of any suitable material which allows the flywheel to perform its intended function. For instance, the flywheel may be insert-molded with different materials that have different performance attributes. As a non-limiting example, a hard plastic material allows the flywheel to get limited traction, allowing it to slip and slide, drift, as well as continue to spin when in contact with a surface, thus keeping its gyroscopic balancing effect even as it continues to perform other actions. A flywheel comprised of a softer material will allow the flywheel to gain greater traction and, therefore, speed in a certain direction. Maximizing weight is a key strategy to improving gyro performance and play duration.

Additionally, tread patterns and other moldable design features and performance enhancing shapes and details can also be molded into the flywheel. For example, molded bumps on the flywheel would allow the skateboard deck to hop and jump as the shapes come into contact with the ground. A groove around a tire of the flywheel will allow the flywheel to balance and travel on a string wire, or thin rail. A smooth flywheel will allow the board to travel backwards and then return as the flywheel slowly gains traction. In addition, a smooth flywheel will travel up one side of a half pipe and then return, thereby gaining traction again and traveling back up the other side. As can be appreciated by one skilled in the art, there are numerous shapes and features of the flywheel, other than those described above, that can be utilized to enhance the performance of the skateboard-shaped toy.

In a desired aspect, and as shown in FIG. 1, the skateboard-shaped toy 100 is designed with the displaceable flywheel 104 in the approximate center of the skateboard deck 102, ideally (although not required) biased to one end to a certain degree. The displaceable flywheel 104 is attachable with the skateboard deck 102 in any suitable manner that allows it to be repositionable. As a non-limiting example, the displaceable flywheel 104 is housed independently in a sub-chassis 108 (or turntable) that is inserted into a frame 110 (or bezel) in the skateboard deck 102. In a desired aspect, this arrangement allows the displaceable flywheel 104 along with the sub-chassis 108 to be removable as well as positioned in a variety of locations and orientations in the skateboard deck 102. Alternatively, the displaceable flywheel 104 can be placed in a fixed position in the skateboard deck 102 allowing the same performance. For instance, the displaceable flywheel 104 may be rotatable and/or repositionable within the skateboard deck 102 without the option of being removed.

The displaceable flywheel 104 has a rotational axis, and, in one aspect, the skateboard deck 102 is formed such that the displaceable flywheel 104 is repositionable with respect to the skateboard deck 102. Repositioning the displaceable flywheel 104 within the skateboard deck 102, therefore, alters the rotational axis of the flywheel 104 with respect to a long axis of the skateboard deck 102. In a desired aspect, the flywheel 104 can also be arranged at different positions, up and down, so that the skateboard-shaped toy 100 has variable ride heights. Each of these aspects will be described in detail below.

In one aspect, and as shown in FIG. 1, the displaceable flywheel 104 is positioned parallel to and aligned with the major axis of the skateboard deck 102. The parallel (0 degrees) orientation of the displaceable flywheel 104 produces traditional vehicle play action, with the skateboard-shaped toy 100 traveling in a forward or reverse direction. The parallel play feature is ideal for use on halfpipes and jumps or traditional vehicle floor play.

Figure 2:
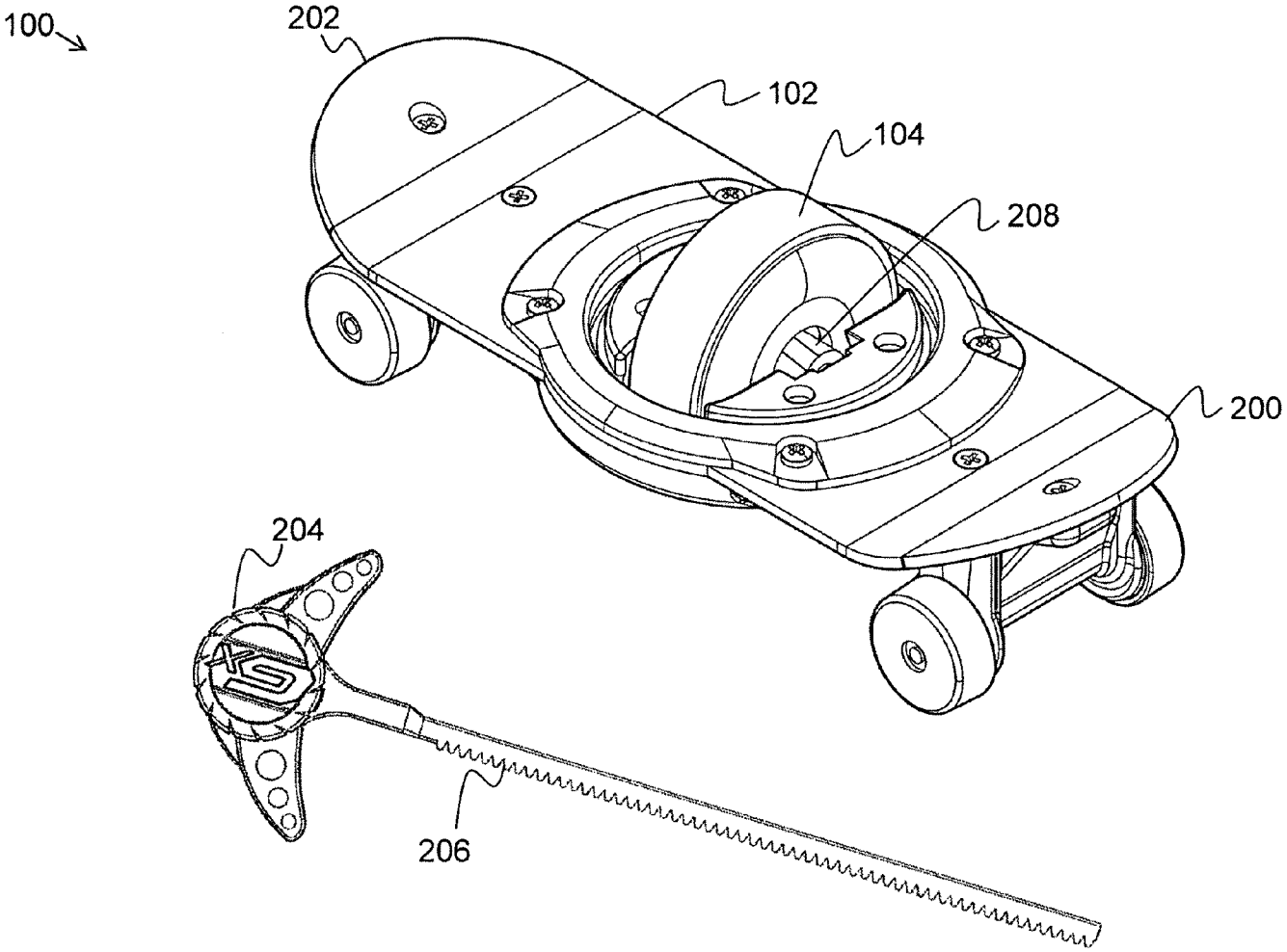
FIG. 2 illustrates a top, perspective-view of a mobile skateboard-shaped toy with a flywheel, depicting the flywheel in a perpendicular position according to the present invention.

FIG. 2 illustrates another aspect of the present invention, depicting the displaceable flywheel 104 positioned perpendicular to the major axis of the skateboard deck 102. The perpendicular (90 degrees) orientation of the displaceable flywheel 104 places the central axis of rotation at the tail 200 and nose 202 of the skateboard deck 102, allowing the skateboard-shaped toy 100 to appear to balance and spin on the tail 200 or nose 202 as a result of the gyroscopic action of the displaceable flywheel 104. With the displaceable flywheel 104 spinning, the skateboard-shaped toy 100 can be coaxed into a number of tricks and balancing effects. The skateboard-shaped toy 100 will slide down rails and stairs, and travel across various terrains and obstacles. Importantly, the displaceable flywheel 104 is not limited to only a parallel or a perpendicular position, but can also be formed such that various angles are possible, as described in detail below.

In a desired aspect, and as shown in FIG. 2, the present invention further comprises a ripcord 204 having a set of teeth 206 along at least one side, which is removably insertable inside the skateboard-shaped toy 100 and is configured to induce rotation of the flywheel 104. The ripcord 204 induces rotation of the flywheel 104 by interlocking with at least a portion of the flywheel 104 or an axle inserted through the flywheel 104. For example, a gear 208 with teeth can be attached with the axle and exposed for engagement with the ripcord 204. As can be appreciated by one skilled in the art, the skateboard-shaped toy 100 may be powered either by a ripcord 204 or a similar device which performs the same function. Additionally, a motorized or manual launcher may be utilized to propel the skateboard-shaped toy 100.

Figure 3A:
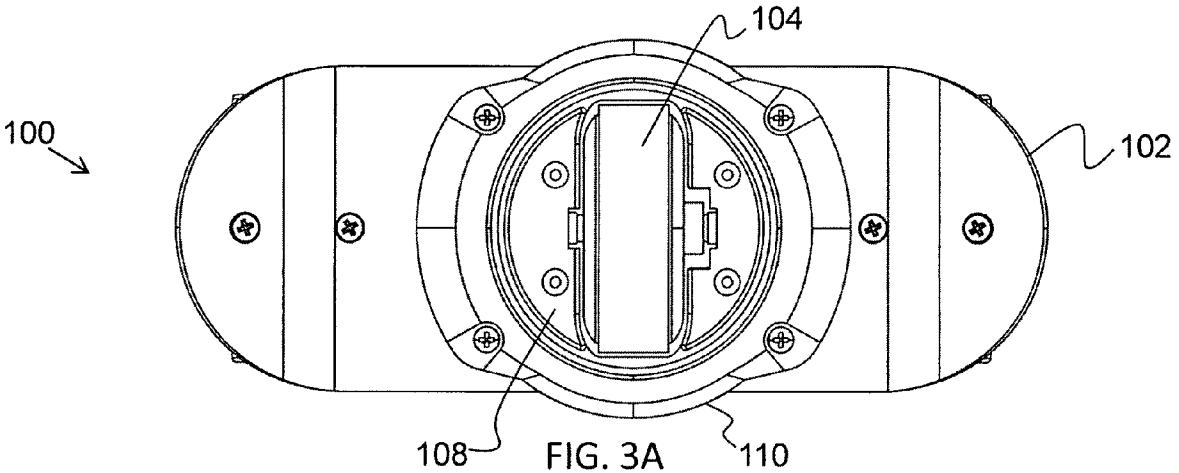
FIGS. 3A and 3B illustrate top-views of a mobile skateboard-shaped toy with a flywheel, depicting the flywheel in a perpendicular position and a parallel position, respectively, according to the present invention.
Figure 3B:
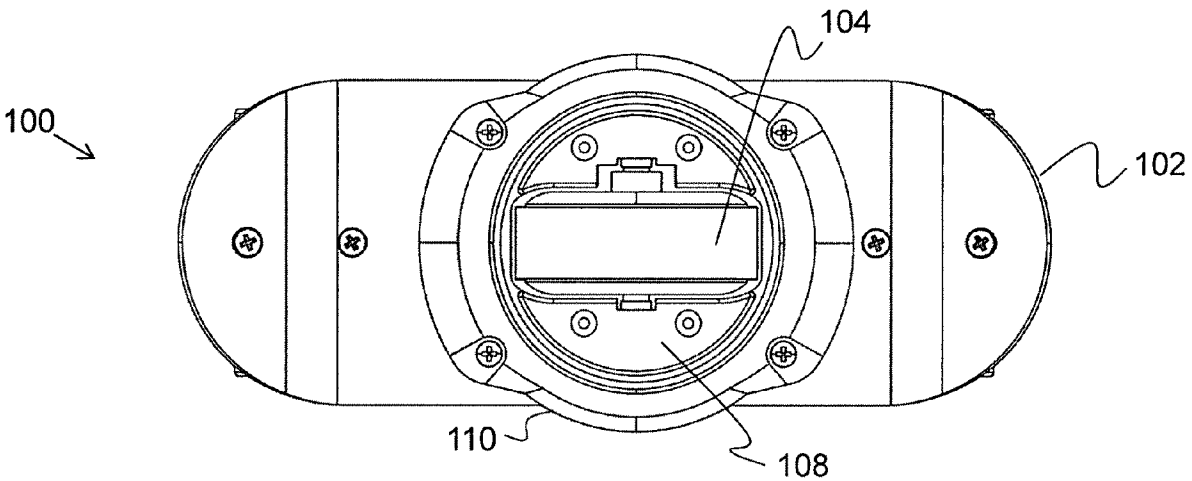

FIGS. 3A and 3B depict top-views of the skateboard-shaped toy 100. In FIG. 3A, the displaceable flywheel 104 is shown positioned perpendicular to the major axis of the skateboard deck 102. The displaceable flywheel 104 is shown positioned parallel to the long (major) axis of the skateboard deck 102 in FIG. 3A. As can be seen in FIGS. 3A and 3B, the sub-chassis 108 is rotated within the frame 110 of the skateboard deck 102 along with the displaceable flywheel 104. In a desired aspect, the displaceable flywheel 104 may also be rotated and repositioned at any position between the parallel (0 degrees) and perpendicular (90 degrees) orientations described above. The ability to infinitely adjust the angle of the displaceable flywheel 104 yields even more unique performance and stunt capabilities.

Figure 4:
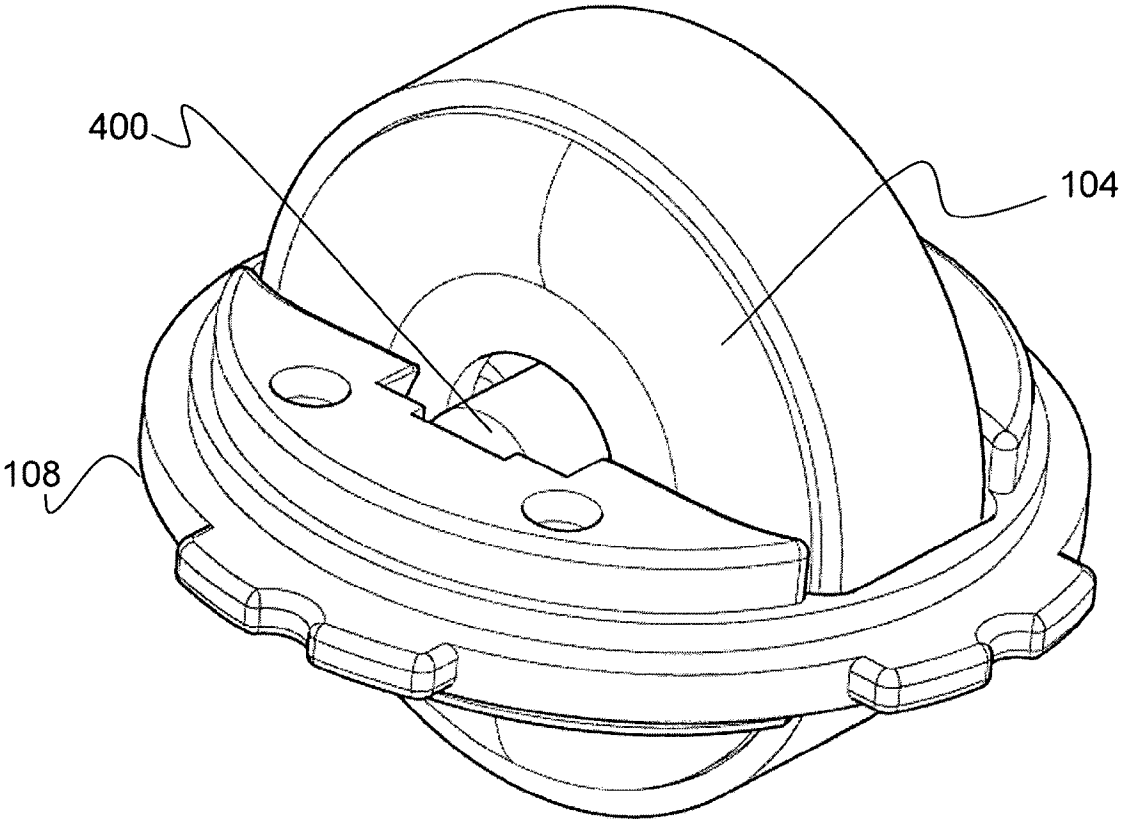
FIG. 4 illustrates a perspective-view of a flywheel positioned in a sub-chassis according to the present invention.

FIG. 4 illustrates the flywheel 104 positioned within the sub-chassis 108. As shown, the flywheel 104 includes an opening (or hub) to allow an axle 400, to be inserted through the opening. The axle 400 may be comprised of any suitable material, non-limiting examples of which include plastic and metal. The axle 400 extends through the opening of the flywheel 104 to both sides of the flywheel 104 for placement into the sub-chassis 108. As described above, the combination of the flywheel 104 and sub-chassis 108 can be removably positioned into the skateboard deck of the skateboard-shaped toy to allow for altering the position of the flywheel 104 and/or replacing one flywheel 104 for another.

Figure 5:
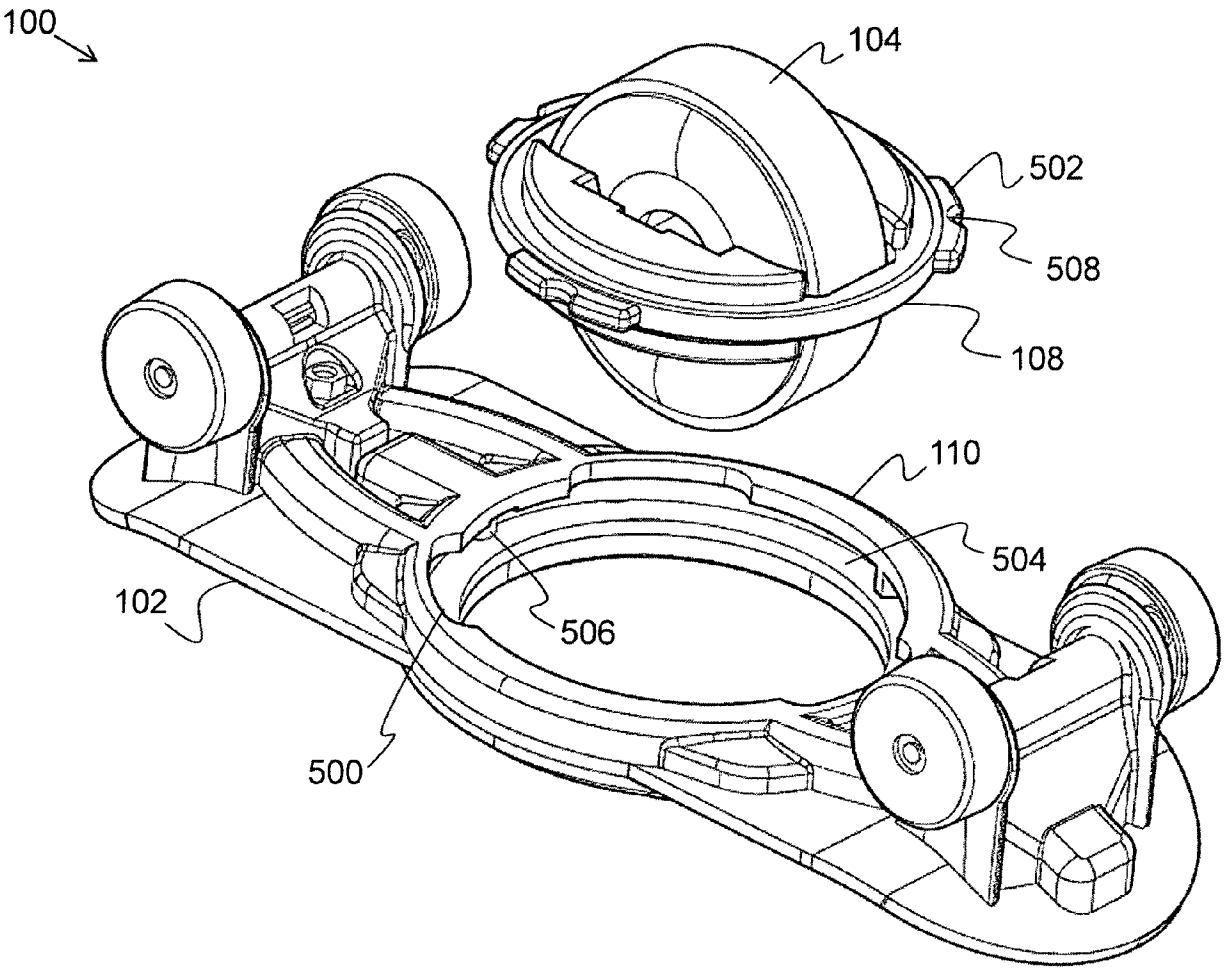
FIG. 5 illustrates a bottom, perspective-view of a mobile skateboard-shaped toy and a flywheel removed from the mobile toy according to the present invention.

FIG. 5 is an illustration of a bottom, perspective-view of the skateboard-shaped toy 100 shown with the flywheel 104 removed from the skateboard deck 102. The frame 110 comprises at least one indentation 500 along the circumference of the frame 110 to receive at least one portion of the sub-chassis 108 so that the sub-chassis 108 can be inserted into the frame 110. As a non-limiting example, and as shown in FIG. 5, the frame 110 includes three indentations 500 sized and shaped to receive three projections 502 in the sub-chassis 108. Once the sub-chassis 108 is inserted into the frame 110, the flywheel 104 can be rotated in various orientations relative to the long axis of the skateboard deck 102 as described above. At least one groove 504 along the circumference of the frame 110 allows rotation of the sub-chassis 108 (and flywheel 104) within the frame 110. In order to lock the flywheel 104 into a particular orientation, there is an interlocking mechanism between the sub-chassis 108 and the frame 110. For instance, as shown in FIG. 5, the frame 110 includes at least one protrusion 506 within a groove 504 which interlocks with a slot 508 in a projection 502 of the sub-chassis 108. As can be appreciated by one skilled in the art, multiple protrusions 506 can be positioned within the frame 110 to allow locking of the flywheel 104 at various orientations relative to the long axis of the skateboard deck 102.

Figure 6B:
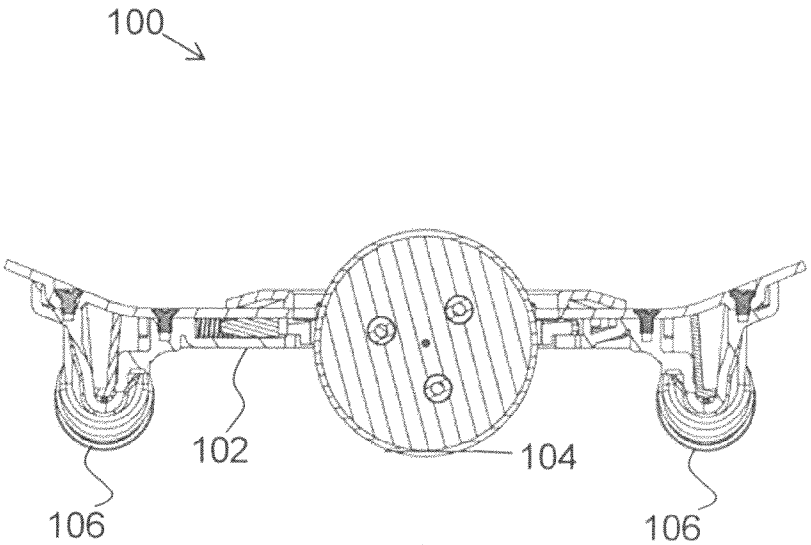
FIG. 6B illustrates a sectional, side-view of a mobile skateboard-shaped toy, depicting the flywheel in a parallel position at a lower ride height according to the present invention.
Figure 6A:
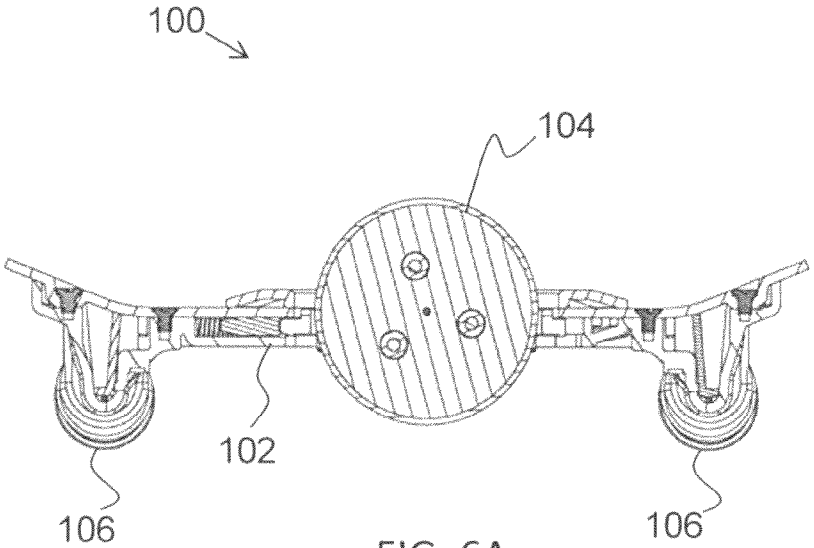
FIG. 6A illustrates a sectional, side-view of a mobile skateboard-shaped toy, depicting the flywheel in a parallel position at a higher ride height according to the present invention.

In addition to being rotationally positionable within the skateboard deck 102, the flywheel 104 may also be placed at different height positions within the skateboard-shaped toy 100, as illustrated in FIGS. 6A and 6B. In order to change the height of the flywheel 104, the flywheel 104 is removed from the skateboard deck 102 and rotated so that the flywheel 104 is positioned higher (as shown in FIG. 6A) or lower (as shown in FIG. 6B) in the skateboard deck 102. In order to achieve this height-adjusting ability, the flywheel 104 is offset inside the sub-chassis (or skateboard deck 102), such that a greater portion of the flywheel 104 extends from the sub-chassis on one side of the sub-chassis compared to the opposite side. Thus, by flipping the sub-chassis over (and attached flywheel 104) and reinserting it in the opposite orientation, the height ride of the skateboard-shaped toy 100 is altered.

In a high clearance position (FIG. 6A), the flywheel 104 is set above the plane formed by the wheels 106. The high clearance position raises the central axis of the flywheel 104, keeping the flywheel 104 from touching the ground in the upright position, as well as moving the focal point of the gyroscopic action to different locations on the skateboard deck 102. In a desired aspect, with the flywheel 104 perpendicular to the skateboard deck 102, the axis of the flywheel 104 now passes directly through an upturned end 600 of the skateboard deck 102, allowing it to spin like a top on one specific point. In addition, the time that the skateboard-shaped toy 100 can spend "floating" on the end 600 of the skateboard deck 102 before losing energy and returning to a flat position is extended.

In a low clearance position (FIG. 6B), the flywheel 104 is set slightly below the plane formed by the wheels 106 of the skateboard-shaped toy 100. The low clearance position allows the flywheel 104 to touch the ground, thus transferring its rotational energy into movement of the skateboard-shaped toy 100. Depending on the rotational positions of the flywheel 104 relative to the skateboard deck 102, different movements on the ground or a play set are possible. At 0 degrees (parallel position), the skateboard-shaped toy 100 moves in a standard forward/backward direction. In the 90 degree position (perpendicular position), the skateboard-shaped toy 100 moves laterally and appears to be doing big slides.

Figure 7:
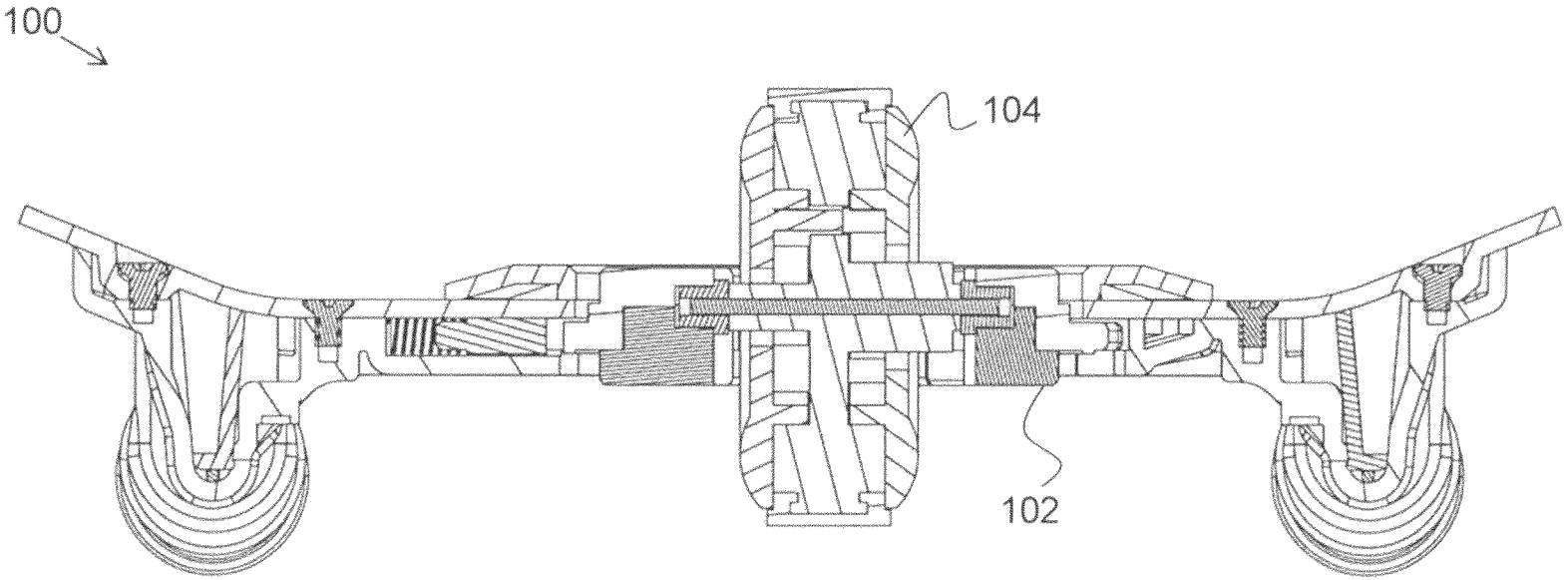
FIG. 7 illustrates a sectional, side-view of a mobile skateboard-shaped toy, depicting the flywheel in a perpendicular position.

FIG. 7 is a sectional, side-view of the skateboard-shaped toy 100. As shown, the flywheel 104 is positioned in the perpendicular position (90 degrees), wherein the flywheel 104 is inserted in a position which is perpendicular to the skateboard deck 102.

The shape of the skateboard deck also has performance benefits. By varying the profile of the skateboard deck, variations tricks and stunt abilities are possible. For instance, notches and detents in the edges of the skateboard deck allow the skateboard-shaped toy to perform rail slides and grinds. Single and double-pointed ends of the skateboard deck create specific locations for the skateboard deck to spin. Furthermore, angled and flat portions in certain areas allow the skateboard deck to settle into off-camber, angled, or vertical spins. As can be appreciated by one skilled in the art, there are numerous shapes and designs of both the skateboard deck and the frame that can influence performance.

What is claimed is:

1. A mobile toy, comprising:

a skateboard-shaped toy having a skateboard deck having a planar surface with a flywheel attachable thereto, the skateboard deck having a nose end and a tail end, with a first pair of wheels proximate the nose and a second pair of wheels proximate the tail end, the first pair of wheels having a first rotational axis passing through the first pair of wheels and the second pair of wheels having a second rotational axis passing through the second pair of wheels;

a sub-chassis that is attached with the flywheel and encompasses a portion of the flywheel;

wherein the sub-chassis comprises a planar surface, and wherein the sub-chassis is insertable within the skateboard deck such that the planar surface of the sub-chassis is substantially aligned with the planar surface of the skateboard deck;

wherein the flywheel is positioned within the skateboard deck such that the flywheel protrudes beyond a top portion and a bottom portion of the skateboard deck and is freely exposed beyond the top portion and bottom portion of the skateboard deck; and wherein the flywheel has a diameter and is positioned in the skateboard deck such that the flywheel is positioned between the first and second rotational axes such that the diameter of the flywheel does not extend beyond a line passing through at least one of the first and second rotational axes.

2. The mobile toy as set forth in claim 1, wherein the skateboard deck includes a frame with an internal circumference and at least one groove along the circumference of the frame, wherein the sub-chassis comprises at least one projection adapted to be received in the groove of the frame, such that the flywheel is a displaceable flywheel.

3. The mobile toy as set forth in claim 2, wherein the groove along the circumference of the frame is adapted to receive the projection and allow for rotation of the sub-chassis within the frame, such that the displaceable flywheel has a rotational axis and the displaceable flywheel is repositionable with respect to the skateboard deck, such that repositioning the displaceable flywheel within the skateboard deck alters the rotational axis of the displaceable flywheel with respect to the skateboard deck.

4. The mobile to as set forth in claim 3, wherein the displaceable flywheel is repositionable within the skateboard deck at different ride heights.

5. The mobile toy as set forth in claim 4, wherein the displaceable flywheel is removable from the skateboard deck, such that the displaceable flywheel may be replaced with another displaceable flywheel.

6. The mobile toy as set forth in claim 5, wherein the frame includes at least one indentation along the circumference of the frame, the indentation sized and shaped to receive the projection of the sub-chassis and allow the projection to enter the groove of the frame, such the sub-chassis is removably attached with the skateboard deck.

7. The mobile toy as set forth in claim 1, wherein the flywheel is positioned in the skateboard deck such that the diameter of the flywheel does not extend beyond a line passing through either of the first and second rotational axes.

8. A method for forming a mobile toy, comprising acts of:

forming a skateboard-shaped toy having a skateboard deck having a planar surface with a flywheel attachable thereto, the skateboard deck having a nose end and a tail end, with a first pair of wheels proximate the nose and a second pair of wheels proximate the tail end, the first pair of wheels having a first rotational axis passing through the first pair of wheels and the second pair of wheels having a second rotational axis passing through the second pair of wheels;

forming a sub-chassis that is attached with the flywheel and encompasses a portion of the flywheel, wherein the sub-chassis comprises a planar surface;

inserting the sub-chassis within the skateboard deck such that the planar surface of the sub-chassis is substantially aligned with the planar surface of the skateboard deck; and positioning the flywheel in the skateboard deck such that the flywheel protrudes beyond a top portion and a bottom portion of the skateboard deck and is freely exposed beyond the top portion and bottom portion of the skateboard deck, wherein the flywheel has a diameter and is positioned in the skateboard deck such that the flywheel is positioned between the first and second rotational axes such that the diameter of the flywheel does not extend beyond a line passing through at least one of the first and second rotational axes.

9. The method for forming a mobile toy as set forth in claim 8, further comprising an act of forming the skateboard deck to include a frame with an internal circumference and at least one groove along the circumference of the frame, and forming the sub-chassis to include at least one projection adapted to be received in the groove of the frame, such that the flywheel is formed to be a displaceable flywheel.

10. The method for forming a mobile toy as set forth in claim 9, further comprising acts of forming the frame such that the groove is adapted to receive the projection and allow for rotation of the sub-chassis within the frame, such that the displaceable flywheel has a rotational axis and is repositionable with respect to the skateboard deck, wherein repositioning the displaceable flywheel within the skateboard deck alters the rotational axis of the displaceable flywheel with respect to the skateboard deck.

11. The method for forming a mobile toy as set forth in claim 10, further comprising an act of forming the displaceable flywheel to be repositionable within the skateboard deck at different ride heights.

12. The method for forming a mobile toy as set forth in claim 11, further comprising an act of forming the displaceable flywheel to he removable from the skateboard deck, such that the displaceable flywheel may be replaced with another displaceable flywheel.

13. The method for forming a mobile toy as set forth in claim 12, further comprising an act of forming the frame to includes at least one indentation along the circumference of the frame, the indentation sized and shaped to receive the projection of the sub-chassis and allow the projection to enter the groove of the frame such that the sub-chassis is removably attached with the skateboard deck.

14. The method for forming a mobile toy as set forth in claim 8, further comprising an act of positioning the flywheel in the skateboard deck such that the diameter of the flywheel does not extend beyond a line passing through either of the first and second rotational axes.

15. The mobile toy as set forth in claim 3, further comprising an interlocking mechanism between the sub-chassis and the frame, wherein the interlocking mechanism comprises at least one protrusion within the groove of the frame and a slot in the at least one projection of the sub-chassis, wherein the at least one protrusion within the groove is formed to interlock with the slot to reversibly lock the flywheel at various orientations relative to a long axis of the skateboard deck.

16. The method for forming a mobile toy as set forth in claim 10, further comprising an act of forming an interlocking mechanism between the sub-chassis and the frame, wherein the interlocking mechanism comprises at least one protrusion within the groove of the frame and a slot in the at least one projection of the sub-chassis, wherein the at least one protrusion within the groove is formed to interlock with the slot to reversibly lock the flywheel at various orientations relative to a long axis of the skateboard deck.

* * * * *